US008852463B2

(12) United States Patent
Ishikawa et al.

(10) Patent No.: US 8,852,463 B2
(45) Date of Patent: Oct. 7, 2014

(54) METAL FINE PARTICLE FOR CONDUCTIVE METAL PASTE, CONDUCTIVE METAL PASTE AND METAL FILM

(75) Inventors: Dai Ishikawa, Hitachi (JP); Tomiya Abe, Hitachi (JP)

(73) Assignee: Hitachi Metals, Ltd., Tokyo (JP)

( * ) Notice: Subject to any disclaimer, the term of this patent is extended or adjusted under 35 U.S.C. 154(b) by 211 days.

(21) Appl. No.: 12/968,662

(22) Filed: Dec. 15, 2010

(65) Prior Publication Data

US 2011/0248221 A1 Oct. 13, 2011

(30) Foreign Application Priority Data

Apr. 9, 2010 (JP) ..... 2010-090357

(51) Int. Cl.

| | |
|---|---|
| ***H01B 1/22*** | (2006.01) |
| ***H01B 1/02*** | (2006.01) |
| ***C23C 8/34*** | (2006.01) |
| ***B22F 1/00*** | (2006.01) |

(52) U.S. Cl.

CPC ..... *H01B 1/02* (2013.01); *B22F 2999/00* (2013.01); *C23C 8/34* (2013.01); *B22F 1/0062* (2013.01); *B22F 2998/00* (2013.01); *Y10S 977/775* (2013.01); *Y10S 977/777* (2013.01)

USPC ..... 252/514; 252/512; 428/402; 428/404; 977/775; 977/777

(58) Field of Classification Search

USPC ..... 252/500, 512, 513, 514; 428/402, 403; 977/775, 777

See application file for complete search history.

(56) References Cited

U.S. PATENT DOCUMENTS

| | | | | |
|---|---|---|---|---|
| 7,081,214 | B2 * | 7/2006 | Matsuba et al. | 252/512 |
| 2006/0073667 | A1 * | 4/2006 | Li et al. | 438/311 |
| 2009/0029148 | A1 * | 1/2009 | Hashimoto et al. | 428/323 |
| 2010/0186999 | A1 | 7/2010 | Kuramoto et al. | |

FOREIGN PATENT DOCUMENTS

| | | | |
|---|---|---|---|
| JP | 2002299833 A | | 10/2002 |
| WO | WO 2007034922 | * | 3/2007 |
| WO | WO2009/090915 A1 | | 7/2009 |

OTHER PUBLICATIONS

Suganuma, Katsuaki, "Ink-jet Wiring of Fine Pitch Circuits with Metallic Nano Particle Pastes", published by CMC Publishing Co., Ltd. in 2006.

Japanese Official Notification mailed Apr. 3, 2012 in corresponding Japanese Patent Application No. 2010-090357 together with an Information Offer Form mailed Mar. 6, 2012 and English translation.

Moon et al., Nano Metal Particles for Low Temperature Interconnect Technology, Elec. Comp. Tech Conf., IEEE, 2004, pp. 1983-1988, downloaded on Mar. 26, 2009.

Komatsu, Applied Nano Particles Laboratory developed silver particle paste which substitutes a high temperature lead solder, Jul. 7, 2008, downloaded on Oct. 9, 2008, together with a partial English language translation.

Japanese Official Notification mailed May 8, 2012 in corresponding Japanese Patent Application No. 2010-090357 together with an Information Offer Form received Apr. 11, 2012 and English translation.

Japanese Office Action dated Jun. 3, 2014 issued in JP 2010-090357 together with computer-generated English translation.

* cited by examiner

*Primary Examiner* — Mark Kopec
*Assistant Examiner* — Haidung Nguyen
(74) *Attorney, Agent, or Firm* — Scully, Scott, Murphy & Presser, P.C.

(57) ABSTRACT

A metal fine particle for a conductive metal paste includes a protective agent covering a surface of the metal fine particle. An amount of heat generated per unit mass (g) of the metal fine particle is not less than 500 J at a temperature of an external heat source temperature in a range of 200° C. to 300° C. when being calcined by the external heat source. The protective agent includes at least one selected from the group consisting of dipropylamine, dibutylamine, triethylamine, tripropylamine, tributylamine, butanethiol, pentanethiol, hexanethiol, heptanethiol, octanethiol, nonanethiol, decanethiol, undecanethiol and dodecanethiol. The content of the protective agent is in a range of 0.1 to 20% by mass with respect to the mass of the metal fine particle.

18 Claims, 2 Drawing Sheets

METAL FINE PARTICLE FOR CONDUCTIVE METAL PASTE, CONDUCTIVE METAL PASTE AND METAL FILM

The present application is based on Japanese Patent Application No. 2010-090357 filed on Apr. 9, 2010, the entire contents of which are incorporated herein by reference.

BACKGROUND OF THE INVENTION

1. Field of the Invention

The invention relates to a metal fine particle for conductive metal paste that is used for the formation of an electronic circuit formation, solder materials, plating materials and the formation of a wire shielding layer etc. Also, the invention relates to a conductive metal paste and a metal film using the metal fine particle.

2. Description of the Related Art

A metal fine particle means a metal particle having a particle size of about 1-100 nm, and a phenomenon that a melting point is depressed due to a rapid increase in a surface area with respect to particle volume (hereinafter, referred to as melting point depression) is known in metal fine particle. Therefore, diffusion of the metal fine particles at an interface between particles occurs at a temperature lower than the melting point of bulk metal, and a metal bond is formed by progression of fusion (See, e.g., non-patent literary document of Ink-jet Wiring of Fine Pitch Circuits with Metallic Nano Particle Pastes, published by CMC Publishing CO., LTD. in 2006).

A simple metal fine particle is very unstable, and aggregation or fusion of particles proceeds even at around room temperature. Therefore, it is essential to suppress the aggregation or fusion of metal fine particles by coating the surface thereof with an organic substance called protective agent which exhibits adsorption properties. A conductive metal paste, which is a paste composition composed of a metal fine particle for conductive metal paste of which surface is coated with a protective agent and a solvent composition, can be sintered at low temperature using the melting point depression of the metal fine particle, and a conductive metal film can be formed therefrom. However, there is a problem that a metal film after sintering of a conductive metal paste has generally low adhesion to a base material. The adhesion varies as follows depending on the type of base material.

When the base material is metal, there is a case that a metal bond or an alloy layer is formed at an interface between the sintered metal and the metal in the base material, which improves problems of adhesion in some degree. However, when the metal bond or the alloy layer is not formed, the adhesion is inferior to that of a metal film which is formed by vapor-deposition technique or a plating method, and film adhesion required for practical use is often unsatisfied.

Meanwhile, when the base material is ceramic, the adhesion may be ensured by formation of a solid solution layer of metal and ceramics, which is called cermet layer, at an interface between the metal film and the ceramics. However, the adhesion is low in a combination of metal and ceramics without formation of the cermet layer.

When the base material is a macromolecule, different types of substances are merely physically in contact at the interface between the sintered metal and the base material, and the adhesion is hardly obtained.

Following prior arts exist in order to solve the problems of adhesion. Conventional methods are classified broadly into a method for improving a conductive metal paste itself and a method for improving a base material.

The method for improving a conductive metal paste includes a means in which a small amount of compound having adhesion to the base material such as another metal fine particle, ceramic particle or binder resin is added to the conductive metal paste (hereinafter, referred to as prior art 1).

The method for improving a base material includes a method in which a base having adhesion is preliminarily formed on a base material, on which a conductive metal paste will be applied, by using another metal paste, ceramic paste or organic paste, etc., (hereinafter, referred to as prior art 2). In addition, there is a method of changing the nature of the surface of the base material, which includes a method for modifying a surface by chemical treatment and a method in which an anchor effect is obtained by physically roughening the surface of the base material using an atmospheric-pressure plasma method (hereinafter, referred to as prior art 3).

SUMMARY OF THE INVENTION

The problem in the prior art 1 is that sufficiently high conductivity is not necessarily obtained. It is because the presence of ceramic particles or binder which inhibits the fusion of the metal fine particles remains in the metal film even after sintering. The probability of contact among the metal fine particles is low since the ceramics particle or the binder not involved in the sintering is present around the metal fine particles, and as a result, the fusion of the metal fine particles is inhibited. Since the ceramic particle and the binder themselves are an insulator, the conductivity of the metal film is reduced when they remain in the metal film. In other words, the above-mentioned method in which a certain compound is added to the conductive paste in order to improve the adhesion to the base material arises a new problem such as conductivity decrease.

The problem in the prior art 2 is a cost increase and a decrease in productivity. There are two reasons as follows. Firstly, raw material cost increases with increasing new materials for forming a base layer. Secondly, a step of forming the base layer is added and production rates decrease. In addition, the method, itself, for forming the base layer may not be used due to restrictions such as cost, characteristics and a structure required for the base material.

The problem in the prior art 3 is a cost increase and usage restrictions. The reason why the cost increases is that chemicals or apparatuses used increases to perform another chemical or physical treatment for property modification of the surface. The usage restrictions mean that it is not possible to perform modification treatment of the surface because of characteristics required for the base material. Meanwhile, it may not be possible to solve the problem of adhesion by the modification treatment of the surface in the case of a combination in which affinity between the metal film and the base material is significantly low.

It is an object of the invention to provide a metal fine particle for conductive metal paste which can be calcined at low temperature for short time and is excellent in adhesion to a base material, a conductive metal paste and a metal film.

(1) According to one embodiment of the invention, a metal fine particle for a conductive metal paste comprises:

a protective agent covering a surface of the metal fine particle, wherein an amount of heat generated per unit mass (g) of the metal fine particle is not less than 500 J at a temperature of an external heat source temperature in a range of 200° C. to 300° C. when being calcined by the external heat source.

In the above embodiment (1) of the invention, the following modifications and changes can be made.

(i) The protective agent comprises at least one selected from the group consisting of dipropylamine, dibutylamine, triethylamine, tripropylamine, tributylamine, butanethiol, pentanethiol, hexanethiol, heptanethiol, octanethiol, nonanethiol, decanethiol, undecanethiol and dodecanethiol.

(ii) The content of the protective agent is in a range of 0.1 to 20% by mass with respect to the mass of the metal fine particle.

(iii) The metal fine particle comprises an average particle size of 1 to 100 nm.

(iv) The protective agent comprises one selected from triethylamine, a mixture of triethylamine and dodecylamine, octanethiol, a mixture of octanethiol and dodecylamine, and dodecanethiol.

(v) The content of the protective agent is in a range of 8 to 15% by mass with respect to the mass of the metal fine particle.

(2) According to another embodiment of the invention, a conductive metal paste comprises:

the metal fine particle according to the embodiment (1); and a solvent.

(3) According to another embodiment of the invention, a metal film formed with the conductive metal paste according to the embodiment (2).

Points of the Invention

According to one embodiment of the invention, a conductive metal paste including a metal fine particle is constructed such that the metal fine particle can be diffused into a base material by heat generated from a specific protective agent as defined above. Thus, the adhesion between a metal film (formed of the metal fine particle) and the base material can be improved. In addition, the fusion rate of the metal fine particles is accelerated by the heat generation, which allows a decrease in required calcination time.

BRIEF DESCRIPTION OF THE DRAWINGS

Next, the present invention will be explained in more detail in conjunction with appended drawings, wherein.

DETAILED DESCRIPTION OF THE PREFERRED EMBODIMENTS

Figure 1:
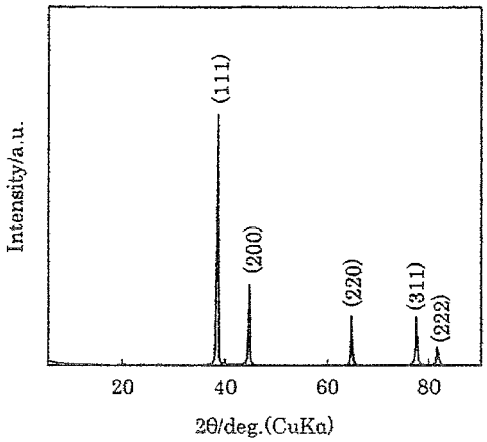
FIG. 1 is a diagram showing a result of powder X-ray diffraction measurement of Ag fine particle in Example 1.

A preferred embodiment of the present invention will be described below.

The inventors found a new fact that 500 or more of heat generation (J/g) of metal fine particle in a certain calcination temperature range provides higher adhesion between a metal film formed of a conductive metal paste including the metal fine particle and a base material compared with conventional conductive paste, and the following invention was completed along with the progress of their intense study.

The amount of heat generation of metal fine particle in the invention is desirably 500 J or more per unit mass (g) of the metal fine particle at an external heat source temperature within a range of 200° C. to 300° C. When the metal fine particle is used as conductive metal paste, there is a possibility that, at a temperature of more than 300° C. in effect, a base material is softened or chemically altered due to high temperature, although depending on the type or property of the base material. Therefore, it is desirable that the metal fine particle generates heat and is sintered in a temperature range of 300° C. or less. When the amount of heat generation of metal fine particle is less than 500 J, there is a possibility that sufficient adhesion is not obtained after being formed into conductive metal paste.

The content of the metal fine particle in the conductive metal paste is desirably within a range of 5-90% by mass with respect to the total mass of the conductive metal paste. When the content of the metal fine particle is more than 90% by mass, the viscosity of the conductive metal paste becomes very high, which may adversely affect coating properties. On the other hand, less than 5% by mass of the content of the metal fine particle is not preferable since the amount of heat generation of the metal fine particle is small and it may be difficult to obtain a smooth metal film with less cracks or holes when the conductive metal paste is calcined. The content can be appropriately changed depending on thickness or paste viscosity of a desired metal film, and the content, which causes less volume shrinkage associated with removal of a solvent composition or a protective agent at the time of calcination and is in a range of 30-80% by mass in which it is easy to obtain a smooth metal film, is more desirable.

More specifically, one or more metals of Au, Ag, Cu, Pt, Pd, Rh, Ru, Os, Ir, Al, Zn, Sn, Co, Ni, Fe, In, Mg, W, Ti, Ta and Mn can be selected as the type of the metal fine particle used in the invention, and metal fine particles in combination of plural metals or that of alloys can be also used.

The average particle size of the metal fine particle can be selected from a range of 1-1000 nm, and is more desirably in a range of 1-100 nm. When the particle size is 100 nm or less, the melting point depression of the metal fine particle is remarkable and the calcination of the conductive metal paste at low temperature is easy. On the other hand, when the particle size is more than 1000 nm, although the melting point is the same as that of bulk metal and a certain level of aggregation or sintering occurs, it is not preferable since calcinations at low temperature is difficult in principle. Meanwhile, the shape of the metal fine particle is not specifically limited, and it may be in a spherical shape, a column shape or other shapes. In view of the previously mentioned melting point depression, the maximum diameter in a range less than 1000 nm is more desirable, regardless of the shape of the metal fine particle.

In micro-scale, an exothermic phenomenon of the metal fine particle in the conductive paste of the invention is considered to proceed as follows. The cause of the heat generation of the metal fine particle for conductive metal paste is combustion heat of a protective agent which is adsorbed on the surface of the metal fine particle, the ambient temperature around the surface of the metal fine particle becomes higher than the temperature set by an external heat source when the protective film generates the combustion heat, and the metal fine particles are rapidly fused in combination with the melting point depression which is typical of the metal fine particle. This exothermic phenomenon occurs not only in a simple metal fine particle but also in a conductive metal paste including a solvent composition mixed thereto. Following is an explanation of an effect of improving adhesion of the conductive metal paste. The protective film on the surface of the metal fine particle is burnt at a certain temperature when the conductive metal paste is calcined, and the heat generated at this time has an effect of diffusing the metal fine particles into the base material and also has an effect of melting the surface of the base material if the base material has a relatively low melting point. Thus, an adhesion layer is likely to be formed from the metal fine particle and the base material. The adhesion layer formed is different depending on the type of the base material, and it is considered that a metal bonding layer or an alloy layer, etc., is formed when the base material is metal, a cermet layer is formed when the base material is ceramic and a layer having an anchor effect in which a metal film anchors into the surface of macromolecule when the base material is a macromolecule, and the adhesion between the metal film and the base material is improved in all cases by forming a layer. Since the high temperature by the conductive metal paste enhances vaporization or decomposition of a protective agent, a solvent and an additive which are included in the conductive metal paste, a metal film excellent in conductivity in which any organic substances do not remain can be obtained at relatively low temperature for short time.

The protective agent for coating the surface of the metal fine particle can be made of a compound which allows coordinative adsorption to the metal fine particle. Specifically, a compound having a functional group which includes atoms having unshared electron pair such as nitrogen, sulfur or oxygen can be coordinatively adsorbed on a metal surface using the unshared electron pair. The functional group including nitrogen, sulfur or oxygen includes, e.g., an amine group (—$NH_2$), a thiol group (—SH) and a carboxyl group (—COOH), etc.

A compound, which has a function as a protective agent for the surface of the metal fine particle of the invention and is likely to generate large combustion heat during the calcination of the metal fine particle, includes dipropylamine, dibutylamine, triethylamine, tripropylamine, tributylamine, butanethiol, pentanethiol, hexanethiol, heptanethiol, octanethiol, nonanethiol, decanethiol, undecanethiol and dodecanethiol, etc., which can be preferably used. The above-mentioned protective agent can be adsorbed on the surface of the metal fine particle by being added in the stage of manufacturing the metal fine particle or in the stage of surface modification.

The content of the protective agent selected from the above group is desirably in a range of 0.1-20% by mass with respect to the mass of the metal fine particle. When the content of the protective film is less than 0.1% by mass with respect to the mass of the metal fine particle, the atmosphere of the entire conductive metal paste does not become sufficiently high temperature due to the small content even though the protective agent is burnt, which results in low adhesion between the metal film and the base material. On the other hand, when the content of the protective film is more than 20% by mass with respect to the mass of the metal fine particle, cracks and holes are likely to be generated in the formed metal film since the heat generation associated with burning of the protective agent is too intense, which results in that conductivity is reduced, and further, there is a high possibility that adhesion to the base material does not appear.

Purity of the protective agent for coating the metal fine particle is desirably 99% or more. Purity of less than 99% is not preferable since there is a possibility that combustion heat of the protective agent decreases due to influence of impurity, and in addition, there is a high possibility that the fusion of the metal fine particle is inhibited by the presence of the impurity, which results in a metal film with low conductivity.

Compounds shown below can be also used as the protective film for coating the surface of the metal fine particle of the invention. An amine compound with an amine group includes, e.g., butylamine, pentylamine, hexylamine, cyclohexylamine, octylamine, laurylamine, stearylamine, oleylamine, benzylamine, dipentylamine, dihexylamine, bis(2-ethylhexyl)amine, dicyclohexylamine, dioctylamine, dilaurylamine, distearylamine, dioleylamine, dibenzylamine, stearyl monoethanolamine, decyl monoethanolamine, hexyl monopropanolamine, benzyl monoethanolamine, phenyl monoethanolamine, tolyl monopropanol, tripropylamine, tributylamine, tripentylamine, trihexylamine, tricyclohexylamine, trioctylamine, trilaurylamine, tristearylamine, trioleylamine, tribenzylamine, dioleyl monoethanolamine, dilauryl monopropanolamine, dioctyl monoethanolamine, dihexyl monopropanolamine, dibutyl monopropanolamine, oleyl diethanolamine, stearyl dipropanolamine, lauryl diethanolamine, octyl dipropanolamine, butyl diethanolamine, benzyl diethanolamine, phenyl diethanolamine, tolyl dipropanolamine, xylyl diethanolamine, triethanolamine and tripropanolamine, etc.

A thiol compound with a thiol group includes, e.g., propanethiol, cyclohexanethiol, thiophenol, 4-chlorothiophenol, 2-anilinethiol, 1,2-ethanedithiol, 2,2'-oxydiethanethiol, 2,2'-thiodiethanethiol, 1,3-propanedithiol, 1,4-butanedithiol, 1,5-pentanedithiol, 1,6-hexanedithiol, 1,9-nonanedithiol, pentaerythrithol, 1,4-cyclohexanedithiol, 1,4-benzenedithiol, 2,4-toluenedithiol, α,α'-o-xylylenedithiol α,α'-m-xylylenedithiol α,α'-p-xylylenedithiol and 1,2,6-hexanetrithiol, etc.

A carbonyl compound with a carboxyl group includes, e.g., formic acid, acetic acid, propionic acid, butyric acid, valeric acid, caproic acid, caprylic acid, enanthic acid, pelargonic acid, lauric acid, myristic acid, palmitic acid, margaric acid, stearic acid, oleic acid, linoleic acid, linolenic acid, malonic acid, succinic acid, glutaric acid, adipic acid, pimelic acid, suberic acid, azelaic acid, sebacic acid, dodecanedioic acid, fumaric acid, maleic acid, phthalic acid, terephthalic acid, isophthalic acid, diphenyl-ether-4,4'-dicarboxylic acid, butane-1,2,4-tricarboxylic acid, cyclohexane-1,2,3-tricarboxylic acid, benzene-1,2,4-tricarboxylic acid, naphthalene-1,2,4-tricarboxylic acid, butane-1,2,3,4-tetracarboxylic acid, cyclobutane-1,2,3,4-tetracarboxylic acid, benzene-1,2,4,5-tetracarboxylic acid, 3,3',4,4'-benzophenone tetracarboxylic acid and 3,3',4,4'-diphenyl ether tetracarboxylic acid, etc.

The protective agent in the above group can be used by appropriately combining with the protective agent listed above, such as dipropylamine, dibutylamine, triethylamine, tripropylamine, tributylamine, butanethiol, pentanethiol, hexanethiol, heptanethiol, octanethiol, nonanethiol, decanethiol, undecanethiol and dodecanethiol, and percentage of the added amount is desirably 50% by mass or less with respect to the above listed protective agent. When the percentage exceeds 50% by mass, it may become difficult to obtain sufficient combustion heat, although depending on a combination.

The type of solvent utilizable in the invention can be selected from the group of water, alcohol, aldehydes, amines, thiols, monosaccharide, polysaccharide, straight-chain hydrocarbons, fatty acids and aromatics. It is desirable that a solvent having an affinity to the protective agent for coating the metal fine particle is selected from the above-mentioned group. The protective agent adsorbed on the metal fine particle by an unshared electron pair is dispersed into the solvent by an effect of a structure other than the atoms involved in adsorption. Therefore, when the structure other than the atoms involved in adsorption is hydrophobic, the protective agent is likely to be dispersed into an organic solvent and a nonpolar solvent. It is possible to appropriately select the solvent in view of the above. Meanwhile, the solvent having a too high affinity to the protective agent is not preferable since the protective agent adsorbed on the surface of the metal fine particle may be dissolved in the solvent, which results in that the metal fine particle is separated from the solvent. In addition, a combination by which the protective agent and the solvent are chemically reacted and are each changed into different compounds should be avoided since it causes aggregation of the metal particles.

Since not a small amount of heat generated by burning of the protective agent is absorbed by a solvent composition in the conductive metal paste, a rate of heat received by the metal fine particle is small when the solvent composition exists excessively at the time of burning the protective agent, hence, diffusion into the base metal does not proceed, resulting in poor adhesion. Therefore, most of the solvent is desirably volatilized or vaporized when the metal fine particle generates heat. Given that the metal fine particle generates heat in a temperature range of 200° C. to 300° C., it is desirable that the boiling point of the solvent is lower than temperature in which heat generation becomes remarkable or that the most part of the solvent has been volatilized at a temperature in which the metal fine particle remarkably generates heat. In addition, the solvent can be selected by taking into consideration the affinity to the base material or the required viscosity. A low polarity solvent or a nonpolar solvent having a boiling point in a range of 100° C. to 300° C. is suitable in light of the handling at around room temperature.

Alternatively, a minute amount of wax or resin as an additive can be added to the solvent in order to control formability and viscosity, etc., of the conductive metal paste. It is possible to enhance formability of the conductive metal paste and to adjust to appropriate viscosity by controlling the type or amount of the additive, however, evaporation temperatures or decomposition temperatures of these additives are generally high in many cases and the additive may not be removed due to the effect of the heat generation if added too much, hence, excessive addition is not preferable.

As described above, the conductive metal paste including the metal fine particle for conductive metal paste of the invention which generates heat of 500 J or more per unit mass (g) of the metal fine particle at an external heat source temperature within a range of 200° C. to 300° C. during calcination by an external heat source permits dispersion of the metal fine particle into the base material by the effect of heat generation, which results in that the adhesion between the metal film and the base material can be improved. In addition, the fusion rate of the metal fine particles is accelerated by the heat generation, which allows calcinations for short time. In addition, adhesion force of the conductive metal paste is characterized in self-heating of the conductive metal paste itself, and since it is not necessary to add another additive to the conductive metal paste, there is no possibility of losing conductivity of the metal film, the manufacturing cost is reduced than the prior art since the necessity of improving base material is eliminated, and further, it is possible to improve productivity.

It should be noted that the present invention is not intended to be limited to the above-mentioned embodiment, and the various kinds of embodiments can be implemented without departing from the gist of the present invention.

EXAMPLES

Specific Examples are shown below, and the invention will be explained in more detail using Tables 1 and 2.

TABLE 1

| Examples | Metal | Particle size [nm] | Protective agent | Amount of protective agent adsorbed to metal [% by mass] | Amount of heat generation of metal particle [J/g] | Type of substrate | Calcination temperature [° C.] | Firing time [min] | Film thickness [μm] | Film resistivity [μΩcm] | Adhesion test: Tape test | Adhesion test: Micro-scratch test [mN] |
|---|---|---|---|---|---|---|---|---|---|---|---|---|
| 1 | Ag | 9 | Triethylamine | 15 | 2000 | Cu substrate | 250 | 30 | 0.27 | 6 | ○ | 31 |
| 2 | Ag | 9 | Triethylamine | 15 | 2000 | Glass substrate | 250 | 30 | 0.27 | 6 | ○ | 27 |
| 3 | Ag | 9 | Triethylamine | 15 | 2000 | Polyimide substrate | 250 | 30 | 0.27 | 6 | ○ | 20 |
| 4 | Ag | 9 | Triethylamine + Dodecylamine | 8 | 1000 | Cu substrate | 250 | 30 | 0.25 | 8 | ○ | 26 |
| 5 | Ag | 9 | Triethylamine + Dodecylamine | 8 | 1000 | Glass substrate | 250 | 30 | 0.25 | 8 | ○ | 24 |
| 6 | Ag | 9 | Triethylamine + Dodecylamine | 8 | 1000 | Polyimide substrate | 250 | 30 | 0.25 | 8 | ○ | 17 |
| 7 | Au | 9 | Octanethiol | 15 | 1800 | Cu substrate | 250 | 30 | 0.15 | 8 | ○ | 33 |
| 8 | Au | 9 | Octanethiol | 15 | 1800 | Glass substrate | 250 | 30 | 0.15 | 8 | ○ | 25 |
| 9 | Au | 9 | Octanethiol | 15 | 1800 | Polyimide substrate | 250 | 30 | 0.15 | 8 | ○ | 18 |
| 10 | Au | 9 | Octanethiol + Dodecylamine | 8 | 500 | Cu substrate | 270 | 30 | 0.20 | 12 | ○ | 20 |
| 11 | Au | 9 | Octanethiol + Dodecylamine | 8 | 500 | Glass substrate | 270 | 30 | 0.20 | 12 | ○ | 16 |
| 12 | Au | 9 | Octanethiol + Dodecylamine | 8 | 500 | Polyimide substrate | 270 | 30 | 0.20 | 12 | ○ | 10 |
| 13 | Au | 9 | Dodecanethiol | 15 | 1500 | Cu substrate | 300 | 30 | 0.18 | 10 | ○ | 33 |
| 14 | Au | 9 | Dodecanethiol | 15 | 1500 | Glass substrate | 300 | 30 | 0.18 | 10 | ○ | 25 |
| 15 | Au | 9 | Dodecanethiol | 15 | 1500 | Polyimide substrate | 300 | 30 | 0.18 | 10 | ○ | 15 |

TABLE 2

| Comparative Examples | Metal | Particle size [nm] | Protective agent | Amount of protective agent adsorbed to metal [% by mass] | Amount of heat generation of metal particle [J/g] | Type of substrate | Calcination temperature [° C.] | Firing time [min] | Film thickness [μm] | Film resistivity [μΩcm] | Adhesion test: Tape test | Adhesion test: Micro-scratch test [mN] |
|---|---|---|---|---|---|---|---|---|---|---|---|---|
| 1 | Ag | 9 | Dodecylamine | 15 | 400 | Cu substrate | 250 | 30 | 0.28 | 24 | Δ | 7 |
| 2 | Ag | 9 | Dodecylamine | 15 | 400 | Glass substrate | 250 | 30 | 0.28 | 24 | X | 2 |
| 3 | Ag | 9 | Dodecylamine | 15 | 400 | Polyimide substrate | 250 | 30 | 0.28 | 24 | X | Unmeasurable |
| 4 | Au | 9 | Dodecylamine | 8 | 220 | Cu substrate | 250 | 30 | 0.23 | 35 | Δ | 5 |
| 5 | Au | 9 | Dodecylamine | 8 | 220 | Glass substrate | 250 | 30 | 0.23 | 35 | X | 1 |
| 6 | Au | 9 | Dodecylamine | 8 | 220 | Polyimide substrate | 250 | 30 | 0.23 | 35 | X | Unmeasurable |

Measurement of each physical property in each Example and each Comparative Example was conducted as follows.

(1) Qualitative Analysis

A powder X-ray diffractometer "RINT2000" (manufactured by Rigaku Corporation) was used for phase identification of the metal fine particle.

(2) Average Particle Size of Metal Fine Particles

A FE-SEM (S-5000, manufactured by Hitachi, Ltd.) was used for observing particles.

(3) Exothermal Behavior of Metal Fine Particle

An amount of heat generation of metal fine particle was measured using a differential scanning calorimeter "Q200" (manufactured by TA Instrument Japan).

(4) Film Thickness and Volume Resistivity of Metal Fine Particle (Film Resistivity)

A FE-SEM was used for film thickness measurement. A 4-probe electrical resistance measuring device was used for measuring volume resistivity of metal film.

(5) Adhesion of Metal Film

Adhesion of metal film was evaluated by a tape peeling test (tape test) and a micro-scratch test. Definitions of symbols for the tape test in Tables are as follows. A circle indicates no peeling of metal film, a triangle indicates partial peeling of metal film and a cross indicates complete peeling of metal film.

Example 1

Figure 2:
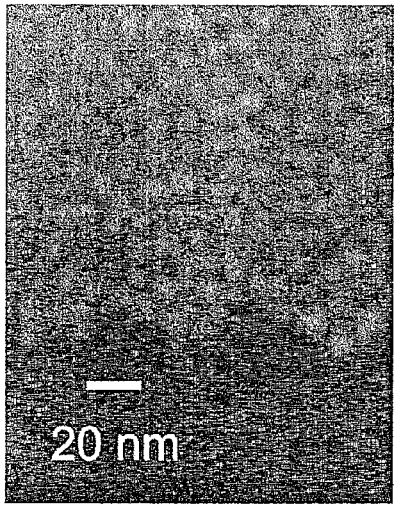
FIG. 2 is a FE-SEM image of the Ag fine particle in Example 1.
Figure 3:
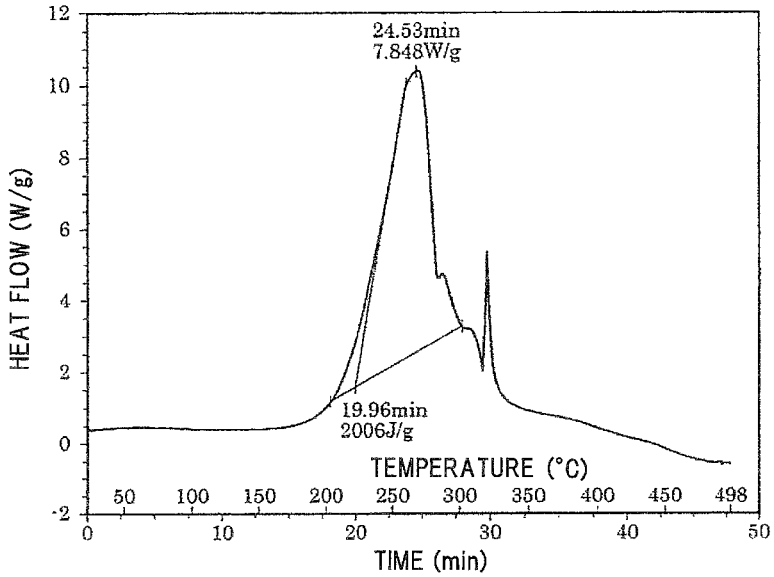
FIG. 3 is a diagram showing a result of differential scanning calorimetry of the Ag fine particle in Example 1.

Ag fine particles with a particle size of 9 nm on which about 15% by mass of triethylamine is adsorbed were synthesized. The result of powder X-ray diffraction measurement of the fine particles shows that a diffraction peak of FIG. 1 showing a fcc structure of metal Ag was obtained, and thus, it was confirmed that the fine particle is Ag. The particle size of the Ag fine particle was confirmed by the results of FE-SEM observation shown in FIG. 2. The result shown in FIG. 3 was obtained from DSC measurement of the Ag fine particle, and heat generation of 2000 J or more per unit mass (g) of the Ag fine particle was confirmed at a DSC heating atmosphere temperature in a range of 200° C. to 300° C. The Ag fine particles were dispersed into a toluene solvent so that the metal content is 65% by mass, thereby making a conductive metal paste. A surface a Cu substrate (1 cm×1 cm) was cleaned with 1% dilute sulfuric acid solution, the conductive metal paste was applied thereto by using a spin coat method, and calcination was carried out at 250° C. for 30 minutes in an electric furnace. The film thickness of the metal film after the calcination was about 0.27 μm. The result of the conductivity measurement of the metal film was 6 μΩcm. The result of the adhesion evaluation by the tape test was that the Ag film was not peeled off. The result of the film adhesion by the micro-scratch test was 31 mN.

Example 2

The conductive metal paste of Example 1 was applied to a glass substrate (2 cm×2 cm) by the spin coat method, and calcination was carried out at 250° C. for 30 minutes in the electric furnace. The film thickness of the metal film after the calcination was about 0.27 μm. The result of the conductivity measurement of the metal film was 6 μΩcm. The result of the adhesion evaluation by the tape test was that the Ag film was not peeled off. The result of the film adhesion by the micro-scratch test was 27 mN.

Example 3

The conductive metal paste of Example 1 was applied to a polyimide substrate (2 cm×2 cm) by the spin coat method, and calcination was carried out at 250° C. for 30 minutes in the electric furnace. The film thickness of the metal film after the calcination was about 0.27 μm. The result of the conductivity measurement of the metal film was 6 μΩcm. The result of the adhesion evaluation by the tape test was that the Ag film was not peeled off. The result of the film adhesion by the micro-scratch test was 20 mN.

Example 4

Ag fine particles with a particle size of 9 nm on which about 7.2% by mass of triethylamine and about 0.8% by mass of dodecylamine is adsorbed were dispersed into a toluene solvent, thereby making a conductive metal paste. From the result obtained from DSC measurement of the Ag fine particle, heat generation of 1000 J or more per unit mass (g) of the Ag fine particle was confirmed at a DSC heating atmosphere temperature in a range of 200° C. to 300° C. The Ag content with respect to the total mass of the conductive metal paste was about 50% by mass. A surface of a Cu substrate (1 cm×1 cm) was cleaned with 1% dilute sulfuric acid solution, the conductive metal paste was applied thereto by using the spin coat method, and calcination was carried out at 250° C. for 30 minutes in the electric furnace. The film thickness of the metal film after the calcination was about 0.25 μm. The result of the conductivity measurement of the metal film was 8 μΩcm. The result of the adhesion evaluation by the tape test was that the Ag film was not peeled off. The result of the film adhesion by the micro-scratch test was 26 mN.

Example 5

The conductive metal paste of Example 4 was applied to a glass substrate (2 cm×2 cm) by the spin coat method, and calcination was carried out at 250° C. for 30 minutes in the electric furnace. The film thickness of the metal film after the calcination was about 0.25 μm. The result of the conductivity measurement of the metal film was 8 μΩcm. The result of the adhesion evaluation by the tape test was that the Ag film was not peeled off. The result of the film adhesion by the micro-scratch test was 24 mN.

Example 6

The conductive metal paste of Example 4 was applied to a polyimide substrate (2 cm×2 cm) by the spin coat method, and calcination was carried out at 250° C. for 30 minutes in the electric furnace. The film thickness of the metal film after the calcination was about 0.25 μm. The result of the conductivity measurement of the metal film was 8 μΩcm. The result of the adhesion evaluation by the tape test was that the Ag film was not peeled off. The result of the film adhesion by the micro-scratch test was 17 mN.

Example 7

Au fine particles with a particle size of 9 nm on which about 15% by mass of octanethiol is adsorbed were dispersed into a toluene solvent, thereby making a conductive metal paste. From the result obtained from DSC measurement of the Au fine particle, heat generation of 1800 J or more per unit mass (g) of the Au fine particle was confirmed at a DSC heating atmosphere temperature in a range of 200° C. to 300° C. The Au content with respect to the total mass of the conductive metal paste was about 30% by mass. A surface of a Cu substrate (1 cm×1 cm) was cleaned with 1% dilute sulfuric acid solution, the conductive metal paste was applied thereto by using the spin coat method, and calcination was carried out at 250° C. for 30 minutes in the electric furnace. The film thickness of the metal film after the calcination was about 0.15 μm. The result of the conductivity measurement of the metal film was 8 μΩcm. The result of the adhesion evaluation by the tape test was that the Au film was not peeled off. The result of the film adhesion by the micro-scratch test was 33 mN.

Example 8

The conductive metal paste of Example 7 was applied to a glass substrate (2 cm×2 cm) by the spin coat method, and calcination was carried out at 250° C. for 30 minutes in the electric furnace. The film thickness of the metal film after the calcination was about 0.15 μm. The result of the conductivity measurement of the metal film was 8 μΩcm. The result of the adhesion evaluation by the tape test was that the Au film was not peeled off. The result of the film adhesion by the micro-scratch test was 25 mN.

Example 9

The conductive metal paste of Example 7 was applied to a polyimide substrate (2 cm×2 cm) by the spin coat method, and calcination was carried out at 250° C. for 30 minutes in the electric furnace. The film thickness of the metal film after the calcination was about 0.15 μm. The result of the conductivity measurement of the metal film was 8 μΩcm. The result of the adhesion evaluation by the tape test was that the Au film was not peeled off. The result of the film adhesion by the micro-scratch test was 18 mN.

Example 10

Au fine particles with a particle size of 9 nm on which about 7.2% by mass of octanethiol and about 0.8% by mass of dodecylamine is adsorbed were dispersed into a toluene solvent, thereby making a conductive metal paste. From the result obtained from DSC measurement of the Au fine particle, heat generation of 500 J or more per unit mass (g) of the Au fine particle was confirmed at a DSC heating atmosphere temperature in a range of 200° C. to 300° C. The Au content with respect to the total mass of the conductive metal paste was about 30% by mass. A surface of a Cu substrate (1 cm×1 cm) was cleaned with 1% dilute sulfuric acid solution, the conductive metal paste was applied thereto by using the spin coat method, and calcination was carried out at 270° C. for 30 minutes in the electric furnace. The film thickness of the metal film after the calcination was about 0.20 μm. The result of the conductivity measurement of the metal film was 12 μΩcm. The result of the adhesion evaluation by the tape test was that the Au film was not peeled off. The result of the film adhesion by the micro-scratch test was 20 mN.

Example 11

The conductive metal paste of Example 10 was applied to a glass substrate (2 cm×2 cm) by the spin coat method, and calcination was carried out at 270° C. for 30 minutes in the electric furnace. The film thickness of the metal film after the calcination was about 0.20 μm. The result of the conductivity measurement of the metal film was 12 μΩcm. The result of the adhesion evaluation by the tape test was that the Au film was not peeled off. The result of the film adhesion by the micro-scratch test was 16 mN.

Example 12

The conductive metal paste of Example 10 was applied to a polyimide substrate (2 cm×2 cm) by the spin coat method, and calcination was carried out at 270° C. for 30 minutes in the electric furnace. The film thickness of the metal film after the calcination was about 0.20 μm. The result of the conductivity measurement of the metal film was 12 μΩcm. The result of the adhesion evaluation by the tape test was that the Au film was not peeled off. The result of the film adhesion by the micro-scratch test was 10 mN.

Example 13

Au fine particles with a particle size of 9 nm on which about 15% by mass of dodecanethiol is adsorbed were dispersed into a toluene solvent, thereby making a conductive metal paste. From the result obtained from DSC measurement of the Au fine particle, heat generation of 1500 J or more per unit mass (g) of the Au fine particle was confirmed at a DSC heating atmosphere temperature in a range of 200° C. to 300° C. The Au content with respect to the total mass of the conductive metal paste was about 30% by mass. A surface of a Cu substrate (1 cm×1 cm) was cleaned with 1% dilute sulfuric acid solution, the conductive metal paste was applied thereto by using the spin coat method, and calcination was carried out at 300° C. for 30 minutes in the electric furnace. The film thickness of the metal film after the calcination was about 0.18 μcm. The result of the conductivity measurement of the metal film was 10 μΩcm. The result of the adhesion evaluation by the tape test was that the Au film was not peeled off. The result of the film adhesion by the micro-scratch test was 33 mN.

Example 14

The conductive metal paste of Example 13 was applied to a glass substrate (2 cm×2 cm) by the spin coat method, and calcination was carried out at 300° C. for 30 minutes in the electric furnace. The film thickness of the metal film after the calcination was about 0.18 μm. The result of the conductivity measurement of the metal film was 10 μΩcm. The result of the adhesion evaluation by the tape test was that the Au film was not peeled off. The result of the film adhesion by the micro-scratch test was 25 mN.

Example 15

The conductive metal paste of Example 13 was applied to a polyimide substrate (2 cm×2 cm) by the spin coat method, and calcination was carried out at 300° C. for 30 minutes in the electric furnace. The film thickness of the metal film after the calcination was about 0.18 μm. The result of the conductivity measurement of the metal film was 10 μΩcm. The result of the adhesion evaluation by the tape test was that the Au film was not peeled off. The result of the film adhesion by the micro-scratch test was 15 mN.

Comparative Example 1

Ag fine particles with a particle size of 9 nm on which about 15% by mass of dodecylamine is adsorbed were synthesized. The heat generation of the Ag fine particle was 400 J/g in a temperature range of 200° C. to 300° C. The Ag fine particles were dispersed into a toluene solvent, thereby making a conductive metal paste. The Ag content with respect to the total mass of the conductive metal paste was about 50% by mass. A surface of a Cu substrate (1 cm×1 cm) was cleaned with 1% dilute sulfuric acid solution, the conductive metal paste was applied thereto by using the spin coat method, and calcination was carried out at 250° C. for 30 minutes in the electric furnace. The film thickness of the metal film after the calcination was about 0.28 μm. The result of the conductivity measurement of the metal film was 24 μΩcm. The result of the adhesion evaluation by the tape test was that the Ag film was partially peeled off. The result of the film adhesion by the micro-scratch test was 7 mN.

Comparative Example 2

The conductive metal paste of Comparative Example 1 was applied to a glass substrate (2 cm×2 cm) by the spin coat method, and calcination was carried out at 250° C. for 30 minutes in the electric furnace. The film thickness of the metal film after the calcination was about 0.28 μm. The result of the conductivity measurement of the metal film was 24 μΩcm. The result of the adhesion evaluation by the tape test was that the Ag film was completely peeled off. The result of the film adhesion by the micro-scratch test was 2 mN.

Comparative Example 3

The conductive metal paste of Comparative Example 1 was applied to a polyimide substrate (2 cm×2 cm) by the spin coat method, and calcination was carried out at 250° C. for 30 minutes in the electric furnace. The film thickness of the metal film after the calcination was about 0.28 μm. The result of the conductivity measurement of the metal film was 24 μΩcm. The result of the adhesion evaluation by the tape test was that the Ag film was completely peeled off. In the micro-scratch test, the film was peeled off and measurement was not possible.

Comparative Example 4

Au fine particles with a particle size of 9 nm on which about 8% by mass of dodecylamine is adsorbed were synthesized. The heat generation of the Au fine particle was 220 J/g in a temperature range of 200° C. to 300° C. The Au fine particles were dispersed into a toluene solvent, thereby making a conductive metal paste. The Au content with respect to the total mass of the conductive metal paste was about 30% by mass. A surface of a Cu substrate (1 cm×1 cm) was cleaned with 1% dilute sulfuric acid solution, the conductive metal paste was applied thereto by using the spin coat method, and calcination was carried out at 250° C. for 30 minutes in the electric furnace. The film thickness of the metal film after the calcination was about 0.23 μm. The result of the conductivity measurement of the metal film was 35 μΩcm. The result of the adhesion evaluation by the tape test was that the Au film was partially peeled off. The result of the film adhesion by the micro-scratch test was 5 mN.

Comparative Example 5

The conductive metal paste of Comparative Example 4 was applied to a glass substrate (2 cm×2 cm) by the spin coat method, and calcination was carried out at 250° C. for 30 minutes in the electric furnace. The film thickness of the metal film after the calcination was about 0.23 μm. The result of the conductivity measurement of the metal film was 35 μΩcm. The result of the adhesion evaluation by the tape test was that the Au film was completely peeled off. The result of the film adhesion by the micro-scratch test was 1 mN.

Comparative Example 6

The conductive metal paste of Comparative Example 4 was applied to a polyimide substrate (2 cm×2 cm) by the spin coat method, and calcination was carried out at 250° C. for 30 minutes in the electric furnace. The film thickness of the metal film after the calcination was about 0.23 μm. The result of the conductivity measurement of the metal film was 35 μΩcm. The result of the adhesion evaluation by the tape test was that the Au film was completely peeled off. In the micro-scratch test, the film was peeled off and measurement was not possible.

From the above results, it is understood that the conductive metal paste including the metal fine particle for conductive metal paste which generates 500 J or more of heat per unit mass (g) of the metal fine particle at an external heat source temperature within a range of 200° C. to 300° C. can be calcined at low temperature for short time, and is excellent in adhesion to the base material.

"Dodecylamine" which is used as a protective agent in Comparative Examples 1-6 is less likely to generate combustion heat on its own, however, "dodecylamine" which itself functions as a protective agent can be combined with a compound more likely to generate combustion heat such as dipropylamine, dibutylamine, triethylamine, tripropylamine, tributylamine, butanethiol, pentanethiol, hexanethiol, heptanethiol, octanethiol, nonanethiol, decanethiol, undecanethiol and dodecanethiol, etc.

Although the invention has been described with respect to the specific embodiment for complete and clear disclosure, the appended claims are not to be therefore limited but are to be construed as embodying all modifications and alternative constructions that may occur to one skilled in the art which fairly fall within the basic teaching herein set forth.

What is claimed is:

1. A metal fine particle with a protective agent for a conductive metal paste, consisting of:

a metal fine particle; and a protective agent covering a surface of the metal fine particle, the protective agent consisting of at least one agent selected from the group consisting of triethylamine, octanethiol, and dodecanethiol, wherein the protective agent content is in a range of 0.1-20% by mass with respect to the mass of the metal fine particle;

wherein the metal fine particle generates an amount of heat not less than 500 J and not more than 2500 J per unit mass (g), upon exposure to a temperature in a range of 200° C. to 300° C. when the metal fine particle is being calcined.

2. A conductive metal paste, comprising:

the metal fine particle with a protective agent according to claim 1; and a solvent.

3. A metal film formed with conductive metal paste according to claim 2.

4. The metal fine particle with a protective agent according to claim 1, further comprising an average particle size of 1 to 100 nm.

5. The metal fine particle with a protective agent according to claim 1, wherein the protective agent comprises one selected from triethylamine, octanethiol and dodecanethiol.

6. The metal fine particle with a protective agent according to claim 1, wherein the content of the protective agent is in a range of 8 to 15% by mass with respect to the mass of the metal fine particle.

7. A metal fine particle with a protective agent for a conductive metal paste, consisting of:

a metal fine particle; and a protective agent covering a surface of the metal fine particle, the protective agent consisting of dodecylamine and at least one other agent selected from the group consisting of triethylamine and octanethiol wherein the protective agent content is in a range of 0.1-20% by mass with respect to the mass of the metal fine particle;

wherein the metal fine particle generates an amount of heat not less than 500 J and not more than 2500 J per unit mass (g), upon exposure to a temperature in a range of 200° C. to 300° C. when the metal fine particle is being calcined.

8. The metal film of claim 3, wherein the film has an adhesion of 15 mN or more.

9. The metal film of claim 3, wherein the film has an adhesion of greater than 30 mN.

10. The metal film of claim 3, wherein the film has a film resistivity of not more than 10 μΩcm.

11. A conductive metal paste, comprising:

the metal fine particle with a protective agent according to claim 7; and a solvent.

12. A metal film formed with conductive metal paste according to claim 11.

13. The metal fine particle of claim 7, wherein the metal fine particle has an average particle size of 1-100 nm.

14. The metal film of claim 12, wherein the film has an adhesion of 10 mN or more.

15. The metal film of claim 12, wherein the film has an adhesion of greater than 18 mN.

16. The metal film of claim 12, wherein the film has a film resistivity of not more than 14 μΩcm.

17. The metal fine particle with a protective agent according to claim 1, wherein the metal fine particle is selected from the group consisting of Ag, Au and combinations thereof.

18. The metal fine particle of claim 7, wherein the metal fine particle is selected from the group consisting of Ag, Au and combinations thereof.

* * * * *